US005242059A

United States Patent [19]

Low et al.

[11] Patent Number: 5,242,059

[45] Date of Patent: Sep. 7, 1993

[54] METHOD AND APPARATUS FOR SORTING MATERIAL

[75] Inventors: John M. Low, Hertfordshire; John E. H. Milbank; Benedict M. M. Deefholts, both of London, all of England

[73] Assignee: Sortex Limited, London, England

[21] Appl. No.: 707,452

[22] Filed: May 30, 1991

[30] Foreign Application Priority Data

Jun. 4, 1990 [GB] United Kingdom ..... 9012417

[51] Int. Cl.[5] ..... B07C 5/00

[52] U.S. Cl. ..... 209/552; 198/372; 198/434; 406/117; 406/113; 406/152; 209/643

[58] Field of Search ..... 209/552, 643, 644, 905; 198/372, 434; 406/117, 113, 152, 153, 192, 141

[56] References Cited

U.S. PATENT DOCUMENTS

| | | | |
|---|---|---|---|
| 1,197,515 | 9/1916 | McDonald | 406/192 |
| 2,550,785 | 5/1951 | Crosset | 209/643 X |
| 2,595,564 | 5/1952 | Hale | 406/192 X |
| 3,095,090 | 6/1963 | Duran | 209/905 X |
| 3,610,697 | 10/1971 | Cone | 406/152 |
| 4,186,836 | 2/1980 | Wassmer et al. | 209/643 X |
| 4,409,746 | 10/1983 | Beck | 406/152 |
| 5,114,280 | 5/1992 | Ushitora et al. | 406/192 X |

FOREIGN PATENT DOCUMENTS

| | | | |
|---|---|---|---|
| 1162763 | 2/1964 | Fed. Rep. of Germany | 406/152 |
| 4348 | 1/1920 | Netherlands | 406/152 |
| 0655892 | 4/1979 | U.S.S.R. | 209/643 |
| 1461535 | 2/1989 | U.S.S.R. | 209/643 |
| 364320 | 1/1932 | United Kingdom | 209/643 |

*Primary Examiner*—D. Glenn Dayoan

*Attorney, Agent, or Firm*—Palmatier, Sjoquist & Helget

[57] ABSTRACT

An apparatus for sorting material conveyed in a product stream and across a substantially level single layer on a conveyor, wherein the conveyor passes beneath an examination device which determines the presence and transverse location of any undesired material; a number of movable conduits are positioned transversely across the conveyor downstream from the examination device, and are arranged in staggered rows to transversely encompass the entire product stream on the conveyor; the suction device and movable conduits are respectively controlled by the examination device, to cause each conduit to selectively move toward the conveyor and remove undesired material from the conveyor as it passes beneath the suction device, and to move away from the conveyor when no undesired material is positioned beneath the suction device; a valve in the common suction line connected to all conduits stabilizes suction pressure during operation of the apparatus.

6 Claims, 3 Drawing Sheets (OPEN)
(CLOSED)
10
11
12
15
16
17
17
20
21
22
22
23
24
25
26
27
30
30
31
31
32
33
34
35
36
36
36
37
40
40

METHOD AND APPARATUS FOR SORTING MATERIAL

BACKGROUND OF THE INVENTION

This invention concerns a method and apparatus for sorting material such, for example, as a foodstuff, into desired and undesired portions thereof.

The term "material", as used herein, is intended to have a broad meaning so as to include pieces of solid material; particulate material; material, e.g. a slurry, containing a liquid; and material in the form of a puree or the like. Moreover the material may be of animal, mineral or vegetable origin or any combination thereof. Although not so restricted, however, the invention is particularly applicable to the sorting of foodstuffs to remove blemished or unwanted parts thereof.

DESCRIPTION OF THE PRIOR ART

It is known in a canning process for canning tomato pieces to pass these pieces on a conveyor belt past a number of operatives who try to remove any calyx or blemished material therefrom by hand. This, however, is a slow and expensive procedure which is not particularly effective in removing all the undesired material and results in substantial loss of good product.

SUMMARY OF THE INVENTION

According, therefore, to the present invention, there is provided apparatus for sorting material into desired and undesired portions thereof comprising support means for supporting material to be sorted; examination means for determining the presence on the support means of any undesired material; at least one conduit means having an inlet portion through which undesired material may be withdrawn from the support means; suction means for communicating with the or each conduit means so as to cause undesired material to be withdrawn therethrough by suction; and movement effecting means, controlled by the examination means, for moving the inlet portion of the or each conduit means between a first position in which it is spaced from the support means and is closed to the suction means, and a second position in which it is adjacent to the support means and is open to the suction means.

Preferably, the inlet portion of the or each conduit means is movable with respect to the remaining portion thereof, each inlet portion, when in the said second position, communicating with the respective remaining portion, and each inlet portion, when in the said first position, being out of communication with the respective remaining portion.

The or each inlet portion may be provided with cutting means which are arranged to separate undesired material from desired material as a result of the inlet portion being moved into the second position, whereby such undesired material may be withdrawn by suction through the inlet portion.

The or each conduit means may have a suction control valve therein which is controlled so that the respective inlet portion is not subjected to suction until the desired material has been separated by the cutting means.

Preferably, the internal cross-section of the or each inlet portion is reduced in a direction away from the support means.

There may be a plurality of conduit means which are arranged longitudinally of and which are arranged to communicate with a common manifold connected to the suction means, the internal cross-section of the common manifold increasing in the direction of flow therethrough. The common manifold may communicate with valve means arranged to keep the pressure of the air in the common manifold substantially constant.

A suction vessel may be provided which communicates with an outlet portion of the or each conduit means.

Preferably, there are means for subjecting the suction vessel to suction throughout the whole of a sorting operation.

Means are preferably provided for effecting relative movement between the support means and the examination means.

The support means may be a conveyor belt for moving the material successively past the examination means and thereafter past the or each inlet portion; the examination means, on detecting undesired material, effecting movement of a respective inlet portion into its second position after a delay such that the undesired material reaches the said respective inlet portion at that time.

Means are preferably provided for producing a substantially level layer of the material on the support means.

There may be a plurality of staggered rows of inlet portions arranged transversely of the conveyor belt.

A receptacle may be arranged to receive desired material which falls off the downstream end of the conveyor belt.

The invention also comprises a method of sorting comprising employing apparatus as set forth above to sort material into desired and undesired portions. Thus the material may be a liquid-containing material or a puree. Alternatively, the undesired material may be constituted by blemished parts of pieces of a foodstuff, the cutting means separating these blemished parts from the remaining parts of the said pieces.

BRIEF DESCRIPTION OF THE DRAWINGS

The invention is illustrated, merely by way of example, in the accompanying drawings, in which.

DETAILED DESCRIPTION OF THE PREFERRED EMBODIMENTS

Figures 1, 2:
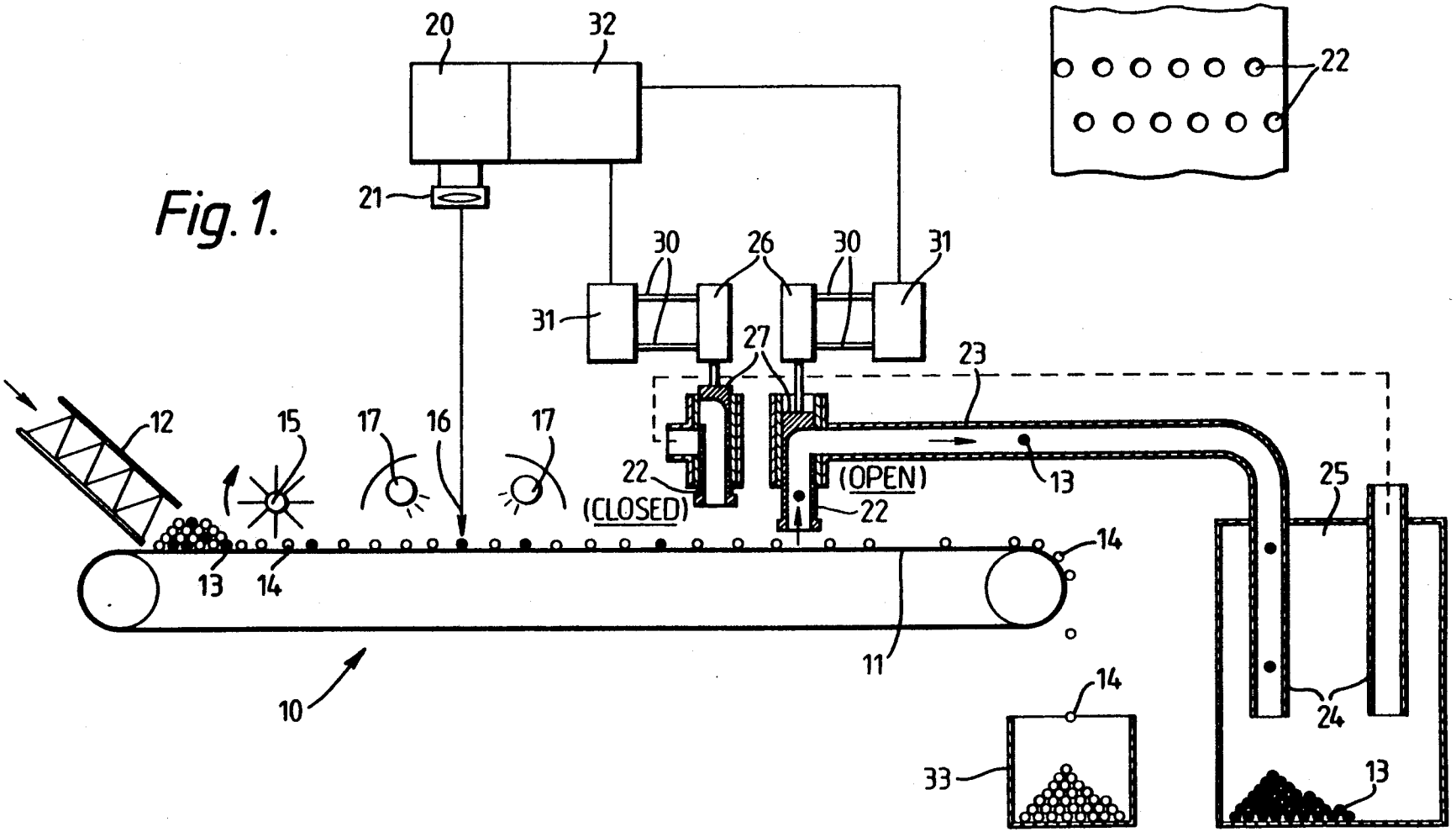
FIG. 1 is a diagrammatic sectional elevation of a first embodiment of an apparatus according to the present invention for sorting material into desired and undesired portions thereof.
FIG. 2 is a broken away plan view of part of the apparatus of FIG. 1.

Referring first to FIGS. 1 and 2, an endless conveyor belt 10, which is driven by means not shown, has an upper run 11 onto an upstream portion of which there are delivered, by a feed conveyor 12, pieces of material (e.g. pieces of tomato) comprising blemished or other undesirable pieces, e.g. calyces, 13 which it is desired to remove, and unblemished pieces 14. The movement of the conveyor belt 10 takes the pieces 13, 14 past a rotary spreader member 15 by means of which the pieces 13, 14 can be formed into a substantially level layer on the conveyor belt 10. The rotary spreader 15 may, however, be replaced by a reciprocating spreader or by any other spreader.

Each of the pieces 13, 14 is moved by the conveyor belt 10 past a viewing station 16 where it is illuminated by lamps 17 and is viewed by a camera 20 having an optical system 21.

After being so viewed, each of the pieces 13, 14 is carried by the conveyor belt 10 beneath one of a plurality of inlet pipes 22 each of which forms an inlet portion of a respective conduit means whose remaining portion is constituted by a conduit 23. As will be seen from FIG. 2, there are two staggered rows of inlet pipes 22 which are arranged transversely of the conveyor belt 10 so as to ensure that any blemished piece 13 will pass directly beneath an inlet pipe 22.

Each of the conduits 23 has an outlet portion 24 which is disposed within a common suction vessel 25 which is provided with means (not shown) for subjecting the suction vessel 25 to suction throughout a sorting operation. Thus blemished pieces 13 may be withdrawn from the conveyor belt 10 by suction so as to pass through the conduit means 22, 23.

Each inlet pipe 22 is movable by a respective air cylinder 26 or other means between a first position in which it is spaced from the conveyor belt 10 and a second position in which it is adjacent to the latter. In FIG. 1, the left hand one of the two inlet pipes 22 illustrated therein is shown as being in the first position while the right hand one of the two inlet pipes 22 is shown as being in the second position.

As clearly shown in FIG. 1, each inlet pipe 22, when in its first position, is out of communication with its respective conduit 23, whereas when it is in its second position, it is in communication with its respective conduit 23. In other words, the part 27 of each inlet pipe 22 remote from the conveyor belt 10 has a valve action with the adjacent part of its respective conduit 23, the said valve being open only when the inlet pipe 22 is in its second position so that the inlet pipe 22 is subjected to suction only at that time.

Each air cylinder 26 is double-acting and is arranged to be driven by compressed air by way of one or other of two compressed air supply pipes 30, the supply of compressed air to each pair of supply pipes 30 being controlled by a respective solenoid valve 31. Each of the solenoid valves 31 is controlled by an electronic control system 32 which forms part of an examination means for determining the presence on the conveyor belt 10 of the blemished pieces 13, the said examination means also comprising the camera 20. The examination means 20, 32 is such that, on detecting a blemished piece 13 at the viewing station 16, a signal is sent by the electronic control system 32 to the respective solenoid valve 31 so that the respective inlet pipe 22 is moved by the respective air cylinder 26 into its said second position after a delay such that the blemished piece 31 reaches the respective inlet pipe 22 at that time. Accordingly, the blemished pieces 13 are removed by suction into the suction vessel 25, whereas the unblemished pieces 14 fall off the downstream end of the conveyor belt 10 into a receptacle 33.

The apparatus shown in FIGS. 1 and 2 is suitable for sorting whole tomatoes as well as tomato puree and may be used for a variety of other purposes such as the removal of black material from a kaolin slurry or the removal of burnt or discoloured material from fruit intended for use in a jam or other foodstuff.

Figure 3:
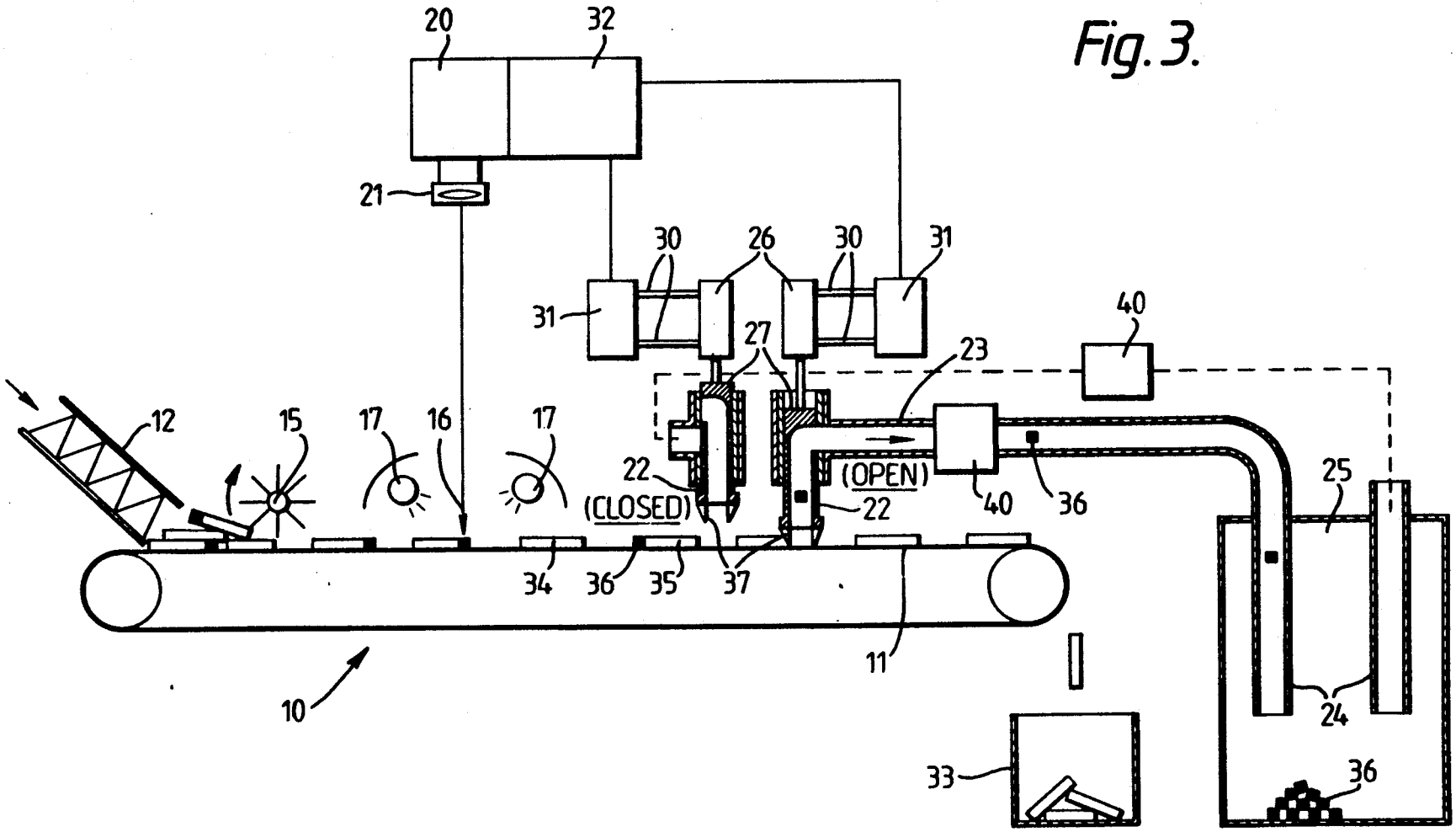
FIG. 3 is a view similar to that of FIG. 1 but illustrating a second embodiment of the present invention.

In FIG. 3 there is shown a second embodiment of the present invention which is generally similar to that of FIGS. 1 and 2 and which for this reason will not be described in detail, like parts being given like reference numerals. The FIG. 3 apparatus, however, is designed to make it particularly suitable for the sorting of pieces of a foodstuff, such as potato "chips", some of which have blemished parts. Thus in FIG. 3, completely unblemished pieces are shown at 34, while pieces 35 have blemished parts 36.

In the FIG. 3 construction, each of the inlet pipes 22 is provided at its end adjacent to the conveyor belt 10 with a defect cutting blade 37 which is arranged to separate any blemished part 36 from a piece 35 as a result of the inlet pipe 22 being moved into its said second position, whereby such a blemished part 36 may be withdrawn by suction through the inlet pipe 22. Each conduit 23, moreover, has a suction control valve 40 therein which is controlled by the electronic control system 32 so that the respective inlet pipe 22 is not subjected to suction until the blemished part 36 has been separated by the defect cutting blade 37.

Thus the blemished parts 36 are removed by suction into the suction vessel 25, whereas the unblemished pieces 34 and the unblemished portions of the pieces 35 fall off the downstream end of the conveyor belt 10 and so into the receptacle 33.

Figure 5:
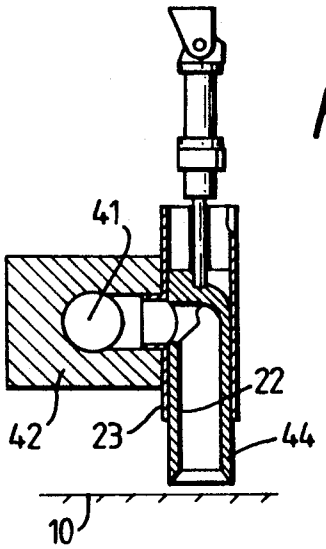
FIG. 5 is a cross-sectional view of a part of the structure shown in FIG. 4.
Figure 4:
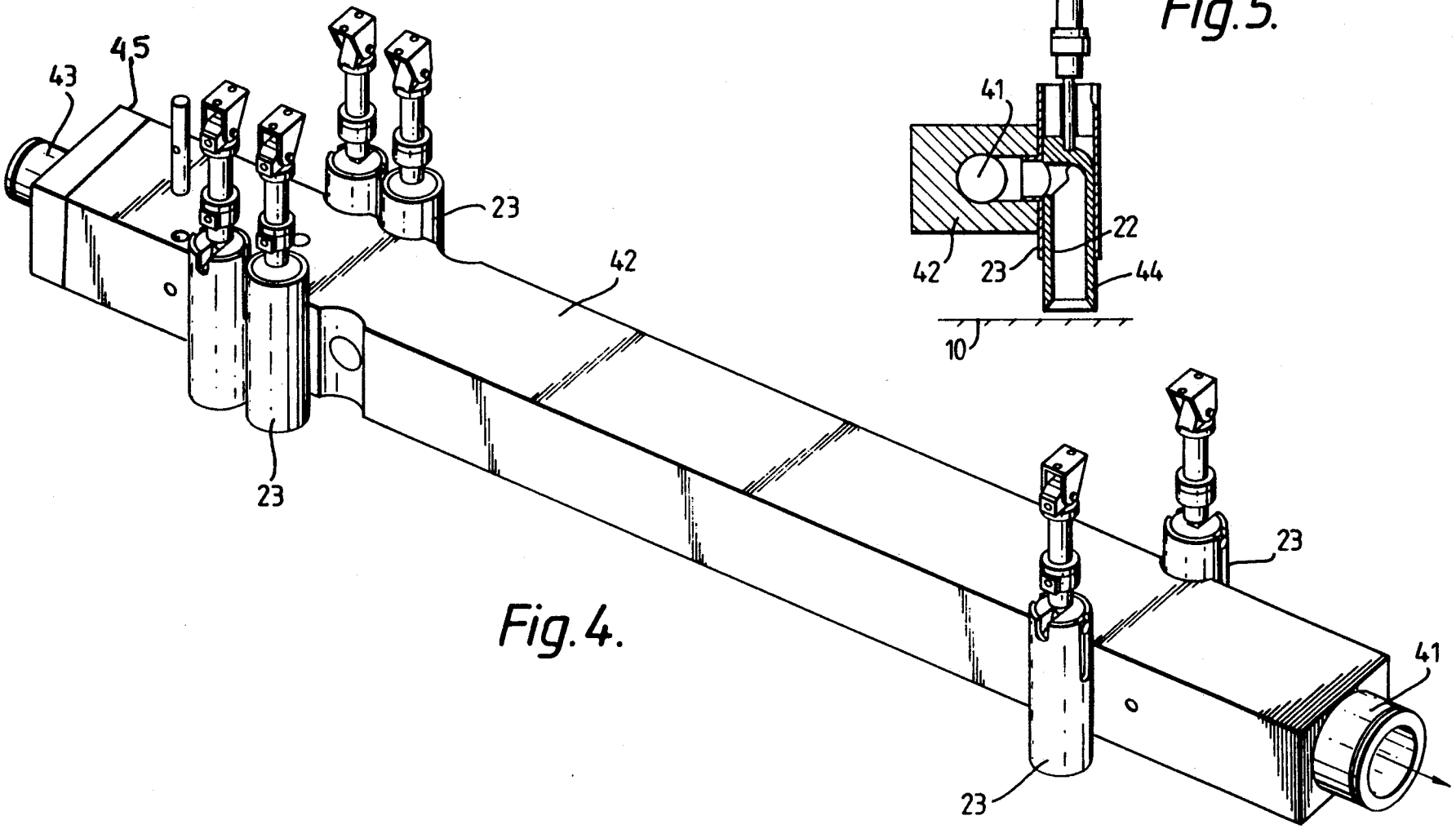
FIG. 4 is a diagrammatic perspective view of a suction portion of a third embodiment of the present invention.

In FIGS. 4 and 5 there is shown a part of a third embodiment of an apparatus according to the present invention which is generally similar to that of either FIGS. 1 and 2 or that of FIG. 3 and which for this reason will not be described in detail, like reference numerals indicating like parts.

In the embodiment of FIGS. 4 and 5, however, all the conduits 23 are arranged longitudinally of and are arranged to communicate with a common manifold 41 which is connected (by means not shown) to a suction source such as the suction vessel 25 shown in FIGS. 1 and 3. The internal cross-section of the common manifold 41 increases in the direction of flow therethrough so that each of the conduits 23 is subjected to substantially the same degree of suction, whereby to assist in preventing material which has been removed from the conveyor belt 10 from falling back on to the latter or from being precipitated onto and building up on a wall or walls of the common manifold 41.

That is to say, if all, or a large number, of the conduits 23 were open at the same time, and if the internal cross-section of the common manifold 41 were constant along its length, the suction source would need to be able to exert a considerable suction force to ensure that the suction was adequate at the conduits 23 most distant from the suction source. The tapering of the common manifold 41, however, reduces the degree of suction which needs to be exerted by the suction source so as to ensure that there will always be an adequate flow of air through the common manifold 41 such as will keep the removed material in suspension therein.

The smaller diameter end 43 of the common manifold 41 may communicate with a valve 45 which automatically moves in a closing or opening direction when the air pressure at the smaller diameter end 43 falls or rises respectively so as to produce automatic stabilisation of the air pressure in the common manifold 41.

As shown in FIG. 5, the inlet pipe 22 of each conduit 23 has an internal cross-section at its end portion 44 adjacent the conveyor belt 10 which is reduced in a direction away from the latter. This accelerates the air passing through the end portion 44 and thus helps to ensure that undesired material passes through the end portion 44 and so into the common manifold 41.

What is claimed is:

1. Apparatus for sorting material being conveyed in a product stream and in a substantially level single layer, comprising:

a) a conveyor support means for conveying and supporting material to be sorted;

b) examination means for determining the presence of the support means of any undesired material;

c) a plurality of conduits arranged in staggered rows transversely across said support means with adjacent conduits being relatively longitudinally displaced along said support means, each conduit having a movable inlet pipe and each inlet pipe having an opening of predetermined cross-sectional area, wherein the plurality of inlet pipe openings are positioned to completely transverse a transverse segment encompassing the entire product stream on said support means; the internal cross section of each inlet pipe being reduced over a short distance from each respective inlet pipe opening;

d) suction means communicating with said plurality of conduits so as to cause undesired material to be withdrawn therethrough by suction; and e) movement effecting means, controlled by said examination means, for moving each said inlet pipe between a first position in which it is spaced from said support means and is closed to said suction means, and a second position in which said inlet pipe opening is adjacent to said support means and the inlet pipe is open to said suction means.

2. The apparatus of claim 1, wherein said suction means further comprises a suction vessel, and a manifold connected to said suction vessel and communicating with said plurality of conduits.

3. The apparatus of claim 2, wherein said manifold is of decreasing cross-sectional area in a direction away from said suction vessel.

4. The apparatus of claim 3, further comprising valve means connected to said manifold, for controlling the air pressure in said manifold.

5. The apparatus of claim 4, wherein said valve means is connected at the end of the manifold having the smaller cross-sectional area.

6. The apparatus of claim 1, wherein said inlet pipes further comprise a round cross section.

* * * * *

UNITED STATES PATENT AND TRADEMARK OFFICE

CERTIFICATE OF CORRECTION

PATENT NO. : 5,242,059

DATED : September 7, 1993

INVENTOR(S) : John M. Low et al

It is certified that error appears in the above-identified patent and that said Letters Patent is hereby corrected as shown below:

Title page, under "[75] Inventors:" delete the name of Benedict M. M. Deefholts as an inventor.

Signed and Sealed this

Twenty-sixth Day of April, 1994

Bruce Lehman

*Attest:*

BRUCE LEHMAN

*Attesting Officer*

*Commissioner of Patents and Trademarks*

US005242059B1

REEXAMINATION CERTIFICATE (2995th)

United States Patent [19] [11] B1 5,242,059

Low et al. [45] Certificate Issued Sep. 10, 1996

[54] METHOD AND APPARATUS FOR SORTING MATERIAL

[75] Inventors: John M. Low, Hertfordshire; John E. H. Milbank, London, both of England

[73] Assignee: Sortex, Ltd., London, England

Reexamination Request:
No. 90/003,793, Apr. 14, 1995

Reexamination Certificate for:

| | |
|---|---|
| Patent No.: | **5,242,059** |
| Issued: | **Sep. 7, 1993** |
| Appl. No.: | **707,452** |
| Filed: | **May 30, 1991** |

Certificate of Correction issued Apr. 26, 1994.

[51] Int. Cl.[6] ..... B07C 5/00

[52] U.S. Cl. ..... 209/552; 209/643; 198/370.12; 198/434; 406/117; 406/113; 406/152

[58] Field of Search ..... 209/552, 643, 209/644, 905; 198/370.12, 434; 406/117, 113, 152, 153

[56] References Cited

U.S. PATENT DOCUMENTS 3,610,697 10/1971 Cone .
4,186,836 2/1980 Wassmer et al. .
4,409,746 10/1983 Beck .

FOREIGN PATENT DOCUMENTS 1162763 2/1964 Germany .
3239567 4/1984 Germany .

*Primary Examiner*—D. Glenn Dayoan

[57] ABSTRACT

An apparatus for sorting material conveyed in a product stream and across a substantially level single layer on a conveyor, wherein the conveyor passes beneath an examination device which determines the presence and transverse location of any undesired material; a number of movable conduits are positioned transversely across the conveyor downstream from the examination device, and are arranged in staggered rows to transversely encompass the entire product stream on the conveyor; the suction device and movable conduits are respectively controlled by the examination device, to cause each conduit to selectively move toward the conveyor and remove undesired material from the conveyor as it passes beneath the suction device, and to move away from the conveyor when no undesired material is positioned beneath the suction device; a valve in the common suction line connected to all conduits stabilizes suction pressure during operation of the apparatus.

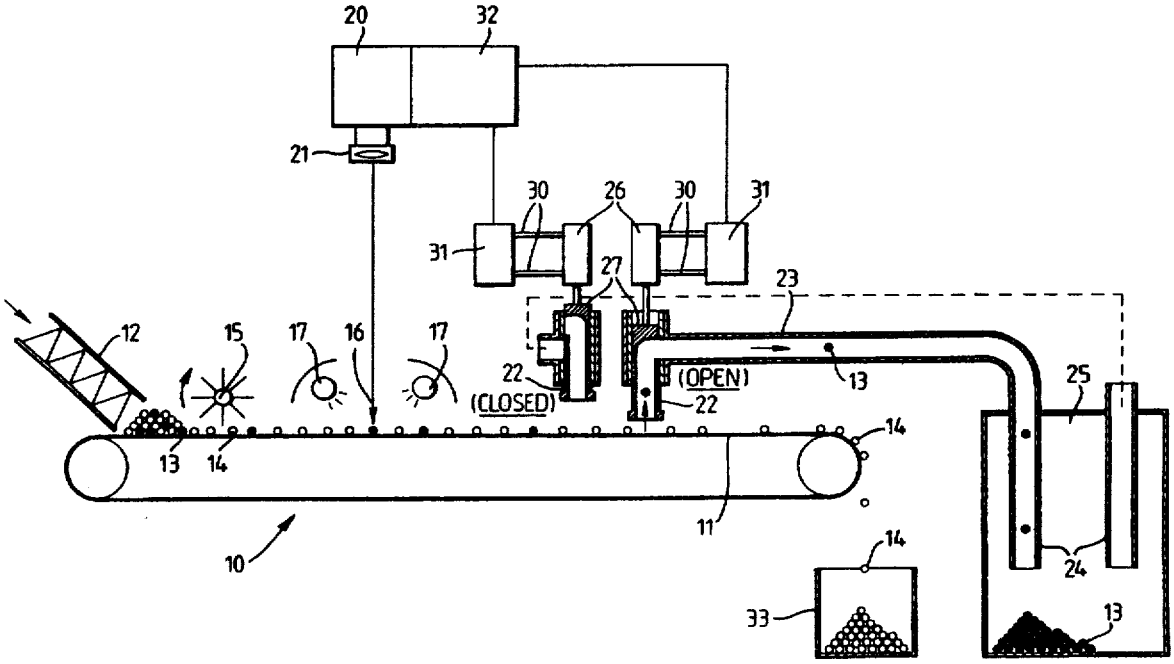

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–6 are cancelled.

* * * * *